US011226076B2

(12) United States Patent
Chen et al.

(10) Patent No.: US 11,226,076 B2
(45) Date of Patent: Jan. 18, 2022

(54) SOLAR LIGHT COLLECTING AND GUIDING SYSTEM

(71) Applicant: JIANGSU UNIVERSITY, Jiangsu (CN)

(72) Inventors: Mingyang Chen, Jiangsu (CN); Xiaoming Xu, Jiangsu (CN); Ling Wang, Jiangsu (CN)

(73) Assignee: JIANGSU UNIVERSITY, Jiangsu (CN)

( * ) Notice: Subject to any disclaimer, the term of this patent is extended or adjusted under 35 U.S.C. 154(b) by 287 days.

(21) Appl. No.: 16/491,458

(22) PCT Filed: Mar. 23, 2018

(86) PCT No.: PCT/CN2018/080111

§ 371 (c)(1),
(2) Date: Sep. 5, 2019

(87) PCT Pub. No.: WO2019/169674

PCT Pub. Date: Sep. 12, 2019

(65) Prior Publication Data

US 2021/0332963 A1 Oct. 28, 2021

(30) Foreign Application Priority Data

Mar. 7, 2018 (CN) ..... 201810186119.0

(51) Int. Cl.
*F21S 11/00* (2006.01)
*F21V 5/04* (2006.01)

(52) U.S. Cl.
CPC ..... *F21S 11/005* (2013.01); *F21V 5/048* (2013.01); *F21V 2200/17* (2015.01)

(58) Field of Classification Search
None
See application file for complete search history.

(56) References Cited

U.S. PATENT DOCUMENTS

2009/0032102 A1 5/2009 Chen et al.
2020/0056754 A1* 2/2020 Di Trapani ..... F21V 14/08

FOREIGN PATENT DOCUMENTS

CN 101482246 A 7/2009
CN 101634746 A 1/2010
(Continued)

*Primary Examiner* — Ashok Patel
(74) *Attorney, Agent, or Firm* — Arent Fox LLP; Michael Fainberg

(57) ABSTRACT

This invention presents a solar light collecting and guiding system for stabilizing the output light intensity, wherein the system comprising an array of converging lenses and optical fibers for collecting light focused by converging lenses. The fibers and the lenses are in one-to-one correspondence wherein the input end of an optical fiber is located in the focus position of the corresponding converging lens, and the axis of the optical fiber overlaps with the principal axis of the corresponding converging lens. The system is equipped with a sunlight tracking positioning device for synchronized motion, wherein the device is applied to tracking the sun light ray vertical incident into the central converging lens. The system has the function of outputting stable light intensity, that is, it can effectively reduce the variation of the collecting efficiency caused by the positioning deviation between the incident angle of sunlight and the designed input angle.

7 Claims, 3 Drawing Sheets

(56) References Cited

FOREIGN PATENT DOCUMENTS

| | | | |
|---|---|---|---|
| CN | 101975358 | A | 2/2011 |
| CN | 102608740 | A | 7/2012 |
| JP | 1068904 | A | 3/1998 |

* cited by examiner

SOLAR LIGHT COLLECTING AND GUIDING SYSTEM

CROSS-REFERENCE TO RELATED APPLICATIONS

This application is the U.S. National Stage Application of International Patent Application No. PCT/CN2018/080111, filed on Mar. 23, 2018, which claims priority to Chinese Patent Application No. 201810186119.0, filed on Mar. 7, 2018, the contents of each of which is incorporated herein by reference in its entirety.

FIELD OF THE INVENTION

The invention relates to the field of solar energy utilization, in particular to a solar light collecting and guiding system.

BACKGROUND OF THE INVENTION

In systems such as solar concentrators, it is generally necessary to converge the solar through a lens system, so as to input into the transmission medium with a small cross-sectional area, such as an optical fiber. Since the size of lens is limited by the manufacturing process and the size of the spot, a plurality of converging lenses are usually used to enhance the intensity of the concentrated light. In the case of a non-tracking lens system, as disclosed in the publication No. JPH02239505A, a 3-branch type light collecting device fixed in three directions such as east, west and south is disclosed, the utilization rate of the lenses is low.

In some non-tracking systems, sunlight is collected by different converging lenses in different time periods, resulting in low lenses utilization and increased system cost. In order to improve the light efficiency of converging focused by the lenses, the solar tracking mechanism of a system is usually used to locate and track the sun. In this way, all the converging lenses are synchronously positioned, so that they can collect more sunlight and achieve high converging efficiency.

Because of the small area of the light spot focused by lenses, the positioning accuracy of the existing solar tracking device can reach 1° or less, but even so, the error generated will affect the intensity of light coupled into the fiber. Even if it has been perfectly positioned, since the relative motion of the sun and the earth is continuous, the deviation angle of the incident parallel solar rays and the plane of the lens gradually increases with time, causing the focused spot to deviate, which will result in part of the sunlight cannot be coupled into the fiber, thereby reducing the coupling efficiency of sunlight. For this reason, the solar tracking positioning device must frequently track the sun and rotate the convergence system. Equipped with a solar tracking and positioning device, such as the patent of U.S. Pat. No. 4,477,145, the lenses of the convergence array are arranged on the same plane, that is, the coupling efficiency of each lens changes the same. Therefore, the coupled light of each lens will experience the same amount of intensity change when there is deviation of tracking and positioning.

In many cases, there are strict requirements on the concentrated light intensity stability. For example, when the concentrated sunlight is applied to illumination, since the human eye is more sensitive to changes in light intensity, frequent changes in light intensity may cause discomfort. To this end, effective measures are needed to reduce the amount of change in the total intensity over time, thereby maintaining the light intensity of the fiber output at a relatively stable level. This requires the tracking and positioning device in the system to have high positioning accuracy and the position must be continuously corrected in a short time interval to ensure that the sunlight intensity remains at a relatively stable level. It results in very high precision requirements for tracking and positioning equipment, and places higher demands on the quality of the system's converging lenses in terms of manufacturing and installation. In addition, frequent positioning and rotation systems increase the complexity of the system and the difficulty of control.

SUMMARY OF THE INVENTION

This invention provides a solar light collecting and guiding system which is able to stabilize the light power collected into the optical fibers.

Herein presents a solar light collecting and guiding system, wherein the system comprising an array of converging lenses, optical fibers, and a sunlight tracking positioning device, which are listed as follows:

1. An array of converging lenses for collecting sunlight into optical fibers, wherein the array is composed of $(2n_x+1)\times(2n_y+1)$ converging lenses arranged in the east-west direction and the north-south direction, where the number of rows and columns of the converging lenses are $2n_x+1$, and $2n_y+1$ respectively, where both $n_x$ and $n_y$ are positive integer no less than 2; wherein the centers of the converging lenses of the same row or the same column are located in a circle, and the principal axes of the converging lenses intersects the circle center; and 2. Optical fibers for collecting light focused by converging lenses wherein the input end of an optical fiber is located in the focus position of the corresponding converging lens, and the axis of the optical fiber overlaps with the principal axis of the corresponding converging lens;

3. A sunlight tracking positioning device, wherein the sunlight tracking positioning device is applied to tracking the sun light ray vertical incident into the central converging lens, and the array of converging lenses and optical fibers move synchronously with the tracking positioning device.

The numbers of converging lenses of the array satisfies the conditions of $$\tan^2(n_x\delta_x)+\tan^2(n_y\delta_y)<\left(\frac{R+r}{f}\right)^2$$

where $\delta_x$ is the angle between the principal axes of two adjacent converging lenses in each row of converging lenses, and $\delta_y$ is the angle between the principal axis of two adjacent converging lenses in each column of converging lenses, R is the radius of the core of the fiber, r is the radius of the light spot of the sunlight concentrated by the converging lens, f is the focal length of the converging lens.

According to the invention, all the converging lenses are of the same type and having the same size and focal length. All the optical fibers are of the same type and having the same core radius and numerical aperture.

The focal length of the converging lens should meet the condition of $$f\geq\frac{D}{2}\sqrt{\frac{1}{NA}-1}$$

where NA is the numerical aperture of the optical fiber and D is the diameter of the converging lens.

The focal length of the converging lens should meet the condition of $$\frac{1.2D}{2}\sqrt{\frac{1}{NA}-1} \geq f$$

The radius of the light spot of the sunlight r concentrated by the converging lens should not be greater than the radius of the fiber core R, that is, r≤R.

The angle between the two adjacent converging lenses in the converging lens array should meet the condition of $$\tan^2(n_x\delta_x+\beta)+\tan^2(n_y\delta_y+\beta)\leq\tan^2(\omega_e)$$

where β is the maximum angle between the sunlight ray and the axis of the central converging lens owing to tracking positioning error, the maximum incident deviation angle $\omega_e$ is the angle between the sunlight ray and the principal axis of the converging lens when the minimum coupling efficiency η for the central converging lens allowed by the system is reached, wherein the maximum incident deviation angle $\omega_e$ and the minimum coupling efficiency η of the central converging lens meet the condition of $$\eta = 1 - \frac{r^2(\varphi - \sin\varphi\cos\varphi) - R^2(\theta - \sin\theta\cos\theta)}{\pi r^2}$$

$$\text{wherein } \theta = \arcsin\frac{d_e^2 + R^2 - r^2}{2d_eR},\ \varphi = \arcsin\left(\frac{R}{r}\sin\theta\right),$$

$$d_e = f \times \tan(\omega_e),$$

where $d_e$ is the lateral offset of the light spot on the focal plane when the angle between the incident ray and the principal axis of the converging lens varies from zero to the maximum deviation angle.

For an array of converging lens arranged in a plane, factors such as tracking error, the movement of the sun, will causing the variation of converging efficiency with time, such variation will lead to unstable output for application such as lighting, and laser pumping. The system of this invention can effectively reduce the variation of the converging efficiency of the system caused by such errors, and can still ensure high converging efficiency of the system even when the positioning and tracking system is working with a relatively large positioning error. Therefore, it is able to effectively stabilize the output light intensity, which is realized by adopting a non-planar arrangement of the converging lenses array, strictly controlling the angular relationship of the adjacent converging lenses and the number of the converging lenses, and matching the parameter relationship between the optical fiber and the lenses.

The robust output light intensity characteristic of the invented system is realized by slightly reducing the coupling efficiency of the converging lenses except the central converging lens. Such design lead to large tolerance to positioning error. In addition, all the converging lenses can work with relatively large coupling efficiencies even when there is relatively large positioning error of the system.

The invented system allows the tracking and positioning device to have a certain angular positioning error. The output light intensity is not sensitive to small changes in the angle of incident sunlight. Therefore, it allows a long tracking and positioning interval time, reducing the system complexity and energy consumption caused by frequent tracking and rotating system.

DETAILED DESCRIPTION OF THE PREFERRED EMBODIMENT

The invention will be further described below in conjunction with the drawings and specific embodiments, but the scope of protection of the invention is not limited thereto.

Figure 1:
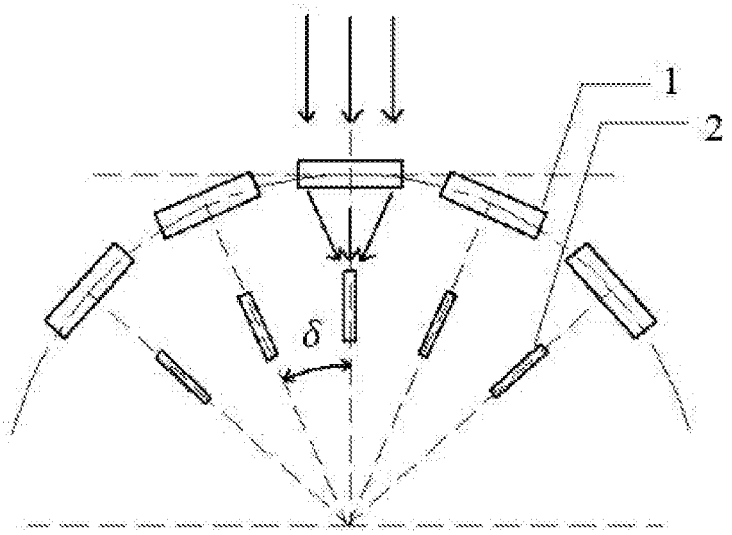
FIG. 1 is a schematic diagram of the convergence light guiding arrangement system of the present invention, where a row of convergence lens and the corresponding optical fiber are presented.

The lenses group located on the same plane is sensitive to the angular deviation, that is, when there is an incident deviation-angle, the amount of light coupled into the optical fiber changes greatly when it is incident perpendicularly to the sunlight. Thus, a solar light collecting and guiding system that stabilizes the intensity of sunlight output is designed for the invention, including a converging lenses array and optical fibers 2. The converging lenses array is composed of $(2n_x+1)\times(2n_y+1)$ converging lenses 1 arranged in the east-west direction and the north-south direction, where the number of rows and columns of the condenser lenses are $2n_x+1$, and $2n_y+1$ respectively, where both $n_x$ and $n_y$ are positive integer no less than 2; wherein the centers of the converging lenses 1 of the same row or the same column are located in a circle, and the principal axes of the converging lenses 1 intersects the circle center. And optical fibers 2. for collecting light focused by converging lenses 1 wherein the input end of an optical fiber 2 is located in the focus position of the corresponding converging lens, and the axis of the optical fiber 2 overlaps with the principal axis of the corresponding converging lens 1;

The solar light collecting and guiding system is provided with a tracking positioning device, and the positioning object of the tracking positioning device is a central converging lens 1 in the sunlight and the converging lens array, and solar light collecting and guiding system follows the tracking positioning device to move synchronously. As shown in FIG. 1, the sunlight passes through the converging lens array and then converges into the corresponding optical fiber for transmission, and when the solar vertical plane mirror is incident, the light is just completely coupled into the optical fiber 2. The numbers of converging lenses of the array satisfies the conditions of $$\tan^2(n_x\delta_x) + \tan^2(n_y\delta_y) < \left(\frac{R+r}{f}\right)^2$$

where $\delta_x$ is the angle between the principal axes of two adjacent converging lenses in each row of converging lenses, and $\delta_y$ is the angle between the principal axis of two adjacent converging lenses in each column of converging lenses, R is the radius of the core of the fiber, r is the radius of the light spot of the sunlight concentrated by the converging lens, f is the focal length of the converging lens.

Figure 2:
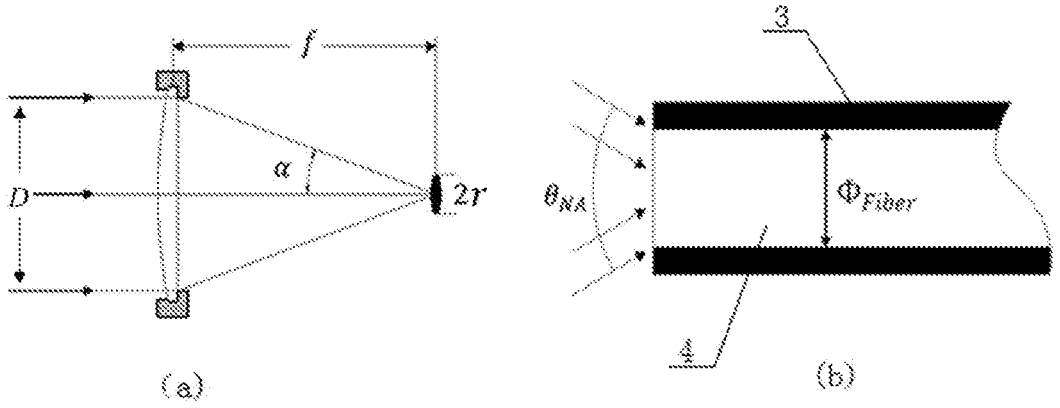
FIG. 2 is a schematic diagram of fully coupled matching principle.

In embodiments, all the converging lenses are of the same type and having the same size and focal length. And all the optical fibers are of the same type and having the same core radius and numerical aperture. As can be seen from the principle of full coupling matching in FIG. 2, the radius r of the converging spot of the parallel sunlight passing through the converging lens 1 should not be greater than the radius R of the core 4, that is, r≤R.

At the same time, the focal length of the converging lens 1 should meet the condition of:

$$f \geq \frac{D}{2}\sqrt{\frac{1}{NA}-1} \text{ and } \frac{1.2D}{2}\sqrt{\frac{1}{NA}-1} \geq f.$$

Figure 3:
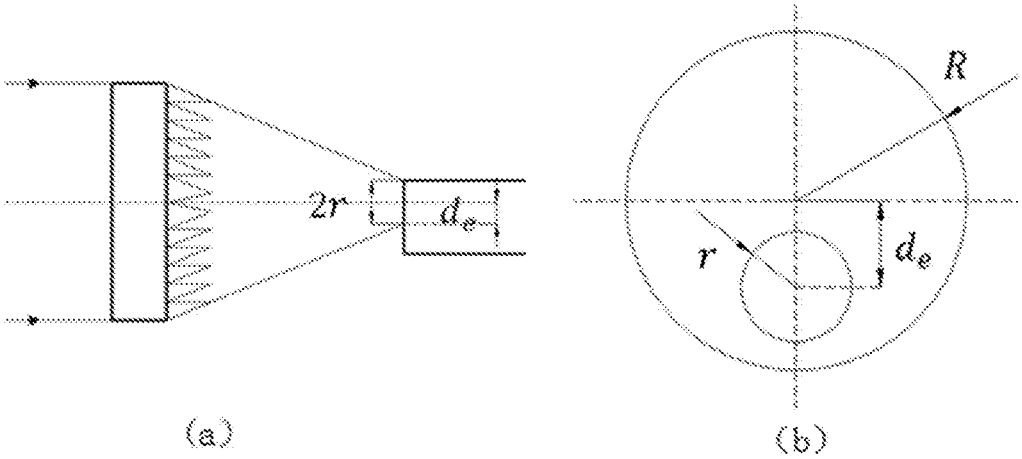
FIG. 3 is a schematic diagram of lateral error of light spot.

And the optical power coupled into the fiber is proportional to the area of the overlap of the light spot and the core 4. Although the solar beam concentrated by the concentrating device satisfies the requirements of the coupling condition of the light and the fiber to some extent, When the center of the concentrated light spot of the sun fails to align with the central axis of the core 4, part of the light will leak into the surrounding environment during the coupling and further causing loss of light as shown in FIG. 3. The lateral error, the maximum incident deviation angle $\omega_e$ and the minimum coupling efficiency η of the central converging lens meet the condition of $$\eta = 1 - \frac{r^2(\varphi - \sin\varphi\cos\varphi) - R^2(\theta - \sin\theta\cos\theta)}{\pi r^2};$$

$$\text{wherein,} \quad \theta = \arcsin\frac{d_e^2 + R^2 - r^2}{2d_eR}, \varphi = \arcsin\left(\frac{R}{r}\sin\theta\right),$$

$$d_e = f \times \tan(\omega_e).$$

And de is the lateral offset of the light spot on the focal plane when the angle between the incident ray and the principal axis of the converging lens varies from zero to the maximum deviation angle. β is the maximum angle between the sunlight ray and the axis of the central converging lens owing to tracking positioning error.

The maximum incident deviation angle $\omega_e$ is the angle between the corresponding incident ray and the principal axis of the converging lens 1 when the single converging lens 1 reaches the minimum coupling efficiency η allowed by the system. After the above definition, it can be ensured that when the sun is tracking within this precision range, when the sunlight is incident on the center lens, all the lenses in the array can collect the light and couple into the corresponding fiber 2.

Figure 4:
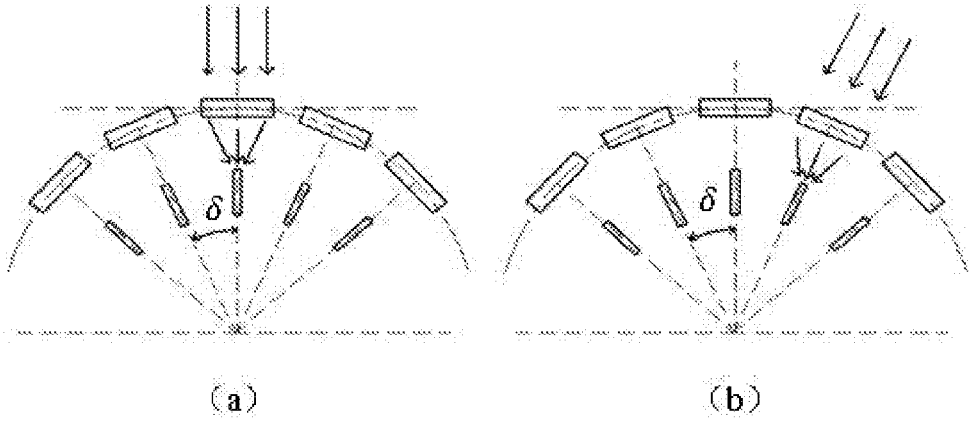
FIG. 4 is a schematic diagram of sunlight incidence at different conditions, with (a) sunlight vertically incident on the center lens, and (b) sunlight incident with an angle with the axis of the center lens.

Obviously, when the incident light is deviated from the principal axis of the converging lens 1, the coupling efficiency of the converging lens 1 is lowered. As shown in FIG. 4*a*, when the sunlight is perpendicularly incident on the central converging lens, the coupling efficiency of the other converging lenses is reduced due to the presence of the incident deviation angle. However, when the angle between the principal axis of the adjacent two converging lenses is small, the influence on the total coupling efficiency is not large. However, if there is a small deviation angle between the sunlight and the central converging lens 1, as shown in FIG. 4*b*, on the contrary, the coupling efficiency of the partial converging lenses 1 may be improved. Thus, the total converging efficiency of all of the converging lenses can be kept at a relatively stable level. It can be seen that the more the number of converging lenses, the higher the stability of the coupling efficiency.

Figure 5:
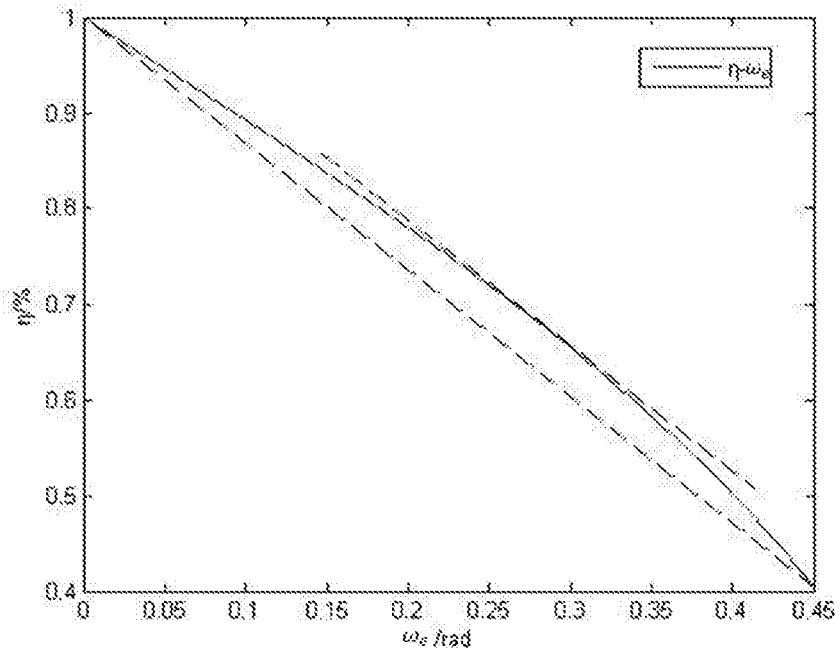
FIG. 5 is a schematic diagram of relationship between coupling efficiency and sunlight incident angle.

The following embodiments are based on the above technical means and requirements. The optical fiber 2 with a radius of 3 mm is used as a transmission medium, and the converging lens 1 with a light spot radius of 3 mm and a focal length of 100 mm is used to converge the sunlight. FIG. 5 is a schematic diagram of relationship between optical coupling efficiency η and incident angle co. It can be seen that η and ω are negatively correlated. Taking n-block lenses 1 as a reference for a row (column), the incident solar rays are coupled into the optical fiber 2 by a unit number of converging lenses 1. If the incident solar rays are parallel to the main axis of the converging lens 1, the coupling efficiency is 100%. When the n-block converging lenses 1 is in the same plane, the coupling efficiency is up to n×100%, which is set as the base coupling efficiency.

Embodiment 1

The seven converging lenses 1 are arranged in one row or one column. If the converging lenses 1 are in the same plane, the coupling efficiency is up to 7×100%, that is, the basic coupling efficiency is 700%. In the behavior example, if the converging lenses 1 system of the invention sets the center plane angle of the adjacent converging lens 1 to be $\delta_x$=0.5°, In the initial state, when the incident solar ray is parallel to the central converging lens 1 principal axis, the maximum coupling efficiency is reduced but it can also reach 688.8848%. When the incident deviation-angle is 0.5°, the coupling efficiency of the converging system of this embodiment is reduced to 687.9568%, and the variation due to the incidence angle of sunlight is only 0.9280%. For comparison, the parameters and the number of the lenses 1 are given the same as in the present embodiment, but the converging lenses are arranged on the same plane. In this case, under the influence of the incident angle of 0.5°, the efficiency is reduced to 693.5181%. The amount of change before and after reached 6.4819%. When the incident deviation-angle is 3°, the coupling efficiency of the concentrating system of this embodiment is reduced to 660.9971%, and the variation due to the incidence angle of sunlight is 27.8877%. The convergence system of the same plane is under the influence of 3° incident angle, the efficiency is reduced to 661.0259%, and the amount of change reaches 38.9741%.

Embodiment 2

The seven converging lenses 1 are arranged in one row or one column. If the converging lenses 1 are in the same plane, the coupling efficiency is up to 7×100%, that is, the basic coupling efficiency is 700%. In the behavior example, if the converging lenses 1 system of the invention sets the center plane angle of the adjacent converging lens 1 to be $\delta_x$=1°, In the initial state, when the incident solar ray is parallel to the central converging lens 1 principal axis, the maximum coupling efficiency is reduced but it can also reach 688.8848%. When the incident deviation angle is 0.5°, the coupling efficiency of the converging system of this embodiment is reduced to 676.8153%, and the variation due to the incidence angle of sunlight is only 0.9301%. For comparison, the parameters and the number of the lenses 1 are given the same as in the present embodiment, but the converging lenses are arranged on the same plane. In this case, under the influence of the incident angle of 0.5°, the efficiency is reduced to 693.5181%. The amount of change before and after reached 6.4819%. When the incident deviation angle is 1.5°, the coupling efficiency of the concentrating system of this embodiment is reduced to 673.0773%, and the variation due to the incidence angle of sunlight is 4.6680%. The convergence system of the same plane is under the influence of 1.5° incident angle, the efficiency is reduced to 680.5449%, and the amount of change reaches 19.4551%.

It can be seen from the above analysis that since the angle between the sun ray and the principal axis of the converging lenses 1 has a large influence on the conventional converging system, frequent tracking and rotating converging systems are required. Since the sunlight is deflected by about 15° per hour, it is deflected by 1° every 4 minutes. From the above analysis, in this embodiment, even when the incident deviation angle is 1.5°, the amount of change in output light intensity is still smaller than that of the convergence system of the same plane at an incident angle of deviation of 0.5°. Therefore, the embodiment can allow the tracking error of the tracking device to reach 0.5°, and can be repositioned for up to 4 minutes, and the variation of the output light intensity does not exceed 4.680%. Thereby, the system complexity and energy consumption brought by the frequent tracking and rotating concentrating system are avoided, and the purpose of stabilizing the output light intensity is achieved.

Embodiment 3

The nine converging lenses 1 are arranged in one row or one column. If the converging lenses 1 are in the same plane, the coupling efficiency is up to 9100%, that is, the basic coupling efficiency is 900%. In the behavior example, if the converging lenses 1 system of the invention sets the center plane angle of the adjacent converging lens 1 to be δ=0.5°, In the initial state, when the incident solar ray is parallel to the central converging lens 1 principal axis, the maximum coupling efficiency is reduced but it can also reach 881.4702%. When the incident deviation angle is 0.5°, the coupling efficiency of the converging system of this embodiment is reduced to 880.5409%, and the variation due to the incidence angle of sunlight is only 0.9294%. For comparison, the parameters and the number of the lenses 1 are given the same as in the present embodiment, but the converging lenses are arranged on the same plane. In this case, under the influence of the incident angle of 0.5°, the efficiency is reduced to 891.6662%. The amount of change reaches 8.3338%. When the incident deviation angle is 1°, the coupling efficiency of the concentrating system of this embodiment is reduced to 877.7524%, and the variation due to the incidence angle of sunlight is 3.7178%. The convergence system of the same plane is under the influence of 1° incident angle, the efficiency is reduced to 883.3293%, and the amount of change reaches 16.6707%.

The embodiments are a preferred embodiment of the invention, but the invention is not limited to the embodiments described above. Any obvious modifications, substitutions or variations that can be made by those skilled in the art without departing from the scope of the invention are the scope of the invention.

What is claimed is:

1. A solar light collecting and guiding system, comprising:

an array of converging lenses for collecting sunlight into optical fibers;

the optical fibers for collecting sunlight focused by the array of converging lenses; and a sunlight tracking positioning device, wherein the array of converging lenses is composed of $(2n_x+1)\times(2n_y+1)$ converging lenses arranged in the east-west direction and the north-south direction, wherein the number of rows and columns of the converging lenses are $2n_x+1$, and $2n_y+1$ respectively, wherein both $n_x$ and $n_y$ are positive integer no less than 2, wherein the centers of the converging lenses of the same row or the same column are located in a circle, and the principal axes of the converging lenses intersects the circle center;

wherein the input ends of the optical fibers are located in the focus position of the corresponding converging lens, and the axes of the optical fibers overlap with the principal axis of the corresponding converging lens;

wherein the sunlight tracking positioning device is applied to tracking the sun light ray vertical incident into the central converging lens, and the array of converging lenses and optical fibers move synchronously with the tracking positioning device; wherein the numbers of converging lenses of the array satisfies the conditions of $$\tan^2(n_x\delta_x)+\tan^2(n_y\delta_y)<\left(\frac{R+r}{f}\right)^2,$$

where $\delta_x$ is the angle between the principal axes of two adjacent converging lenses in each row of converging lenses, and $\delta_y$ is the angle between the principal axis of two adjacent converging lenses in each column of converging lenses, R is the core radius of the optical fibers, r is the radius of the light spot of the sunlight concentrated by the converging lens, and f is the focal length of the converging lens.

2. A solar light collecting and guiding system as claimed in claim 1, wherein all the converging lenses are of the same type and having the same size and focal length.

3. A solar light collecting and guiding system as claimed in claim 1, wherein all the optical fibers are of the same type and having the same core radius and numerical aperture.

4. A solar light collecting and guiding system as claimed in claim 1, wherein the focal length of the converging lens should meet the condition of $$f\geq\frac{D}{2}\sqrt{\frac{1}{NA}-1}$$

where NA is the numerical aperture of the optical fibers and D is the diameter of the converging lens.

5. A solar light collecting and guiding system as claimed in claim 4, wherein the focal length of the converging lens should meet the condition of $$\frac{1.2D}{2}\sqrt{\frac{1}{NA}-1}\geq f.$$

6. A solar light collecting and guiding system as claimed in claim 1, wherein the radius of the light spot of the sunlight r concentrated by the converging lens should not be greater than the core radius of the optical fibers R, that is, r≤R.

7. A solar light collecting and guiding system as claimed in claim 1, wherein the angle between the two adjacent converging lenses in the converging lens array should meet the condition of $$\tan^2(n_x\delta_x+\beta)+\tan^2(n_y\delta_y+\beta)\leq\tan^2(\omega_e)$$

where β is the maximum angle between the sunlight ray and the axis of the central converging lens owing to tracking positioning error, the maximum incident deviation angle $\omega_e$ is the angle between the sunlight ray and the principal axis of the converging lens when the minimum coupling efficiency η for the central converging lens allowed by the system is reached, wherein the maximum incident deviation angle $\omega_e$ and the minimum coupling efficiency η of the central converging lens meet the condition of $$\eta = 1 - \frac{r^2(\varphi - \sin\varphi\cos\varphi) - R^2(\theta - \sin\theta\cos\theta)}{\pi r^2}$$

$$\text{wherein } \theta = \arcsin\frac{d_e^2 + R^2 - r^2}{2d_eR},\ \varphi = \arcsin\left(\frac{R}{r}\sin\theta\right),$$

$$d_e = f \times \tan(\omega_e),$$

where $d_e$ is the lateral offset of the light spot on the focal plane when the angle between the incident ray and the principal axis of the converging lens varies from zero to the maximum deviation angle.

* * * * *